US005671882A

United States Patent [19]

Cerwinski et al.

[11] Patent Number: 5,671,882

[45] Date of Patent: Sep. 30, 1997

[54] WRAPPING PACKAGE

[75] Inventors: Herbert Cerwinski, Grasbrunn-Neukeferloh, Germany; Andreas Niederer, Wagram, Austria

[73] Assignee: Teich Aktiengesellschaft, Austria

[21] Appl. No.: 530,380

[22] PCT Filed: Feb. 16, 1995

[86] PCT No.: PCT/AT95/00035

§ 371 Date: Oct. 17, 1995

§ 102(e) Date: Oct. 17, 1995

[87] PCT Pub. No.: WO95/22496

PCT Pub. Date: Aug. 24, 1995

[30] Foreign Application Priority Data

Feb. 17, 1994 [AU] Australia ..... 312/94

[51] Int. Cl.[6] ..... B65D 75/14; B65D 75/26

[52] U.S. Cl. ..... 229/87.08; 229/87.18; 383/98

[58] Field of Search ..... 229/87.08, 87.18, 229/87.19, 116.5, 923; 387/107, 108, 94, 98

[56] References Cited

U.S. PATENT DOCUMENTS

| | | | |
|---|---|---|---|
| 2,286,307 | 6/1942 | Replogie | 93/2 |
| 2,550,520 | 11/1951 | Bennett | 229/48 |
| 4,881,646 | 11/1989 | Weber | 206/460 |

FOREIGN PATENT DOCUMENTS

| | | | |
|---|---|---|---|
| 0 480 907 A1 | 10/1991 | European Pat. Off. | B65D 75/08 |
| 0 480 907 | 4/1992 | European Pat. Off. | B65D 75/08 |
| 862300 | 3/1961 | Guinea . | |

*Primary Examiner*—Stephen P. Garbe
*Attorney, Agent, or Firm*—Bacon & Thomas

[57] ABSTRACT

A piece of goods to be packaged is wrapped in a wrapping sheet of flexible packaging material made of two different layers or laminated composite materials. Two overlapping marginal areas of the packaging material are sealed or glued together to form the bottom of the package. The layer or laminated composite material that faces the packaged goods within the top marginal area of packaging material has one or several cut-outs, through which both overlapping marginal areas of packaging material are interconnected.

11 Claims, 2 Drawing Sheets

WRAPPING PACKAGE

TECHNICAL FIELD

Figure 1:
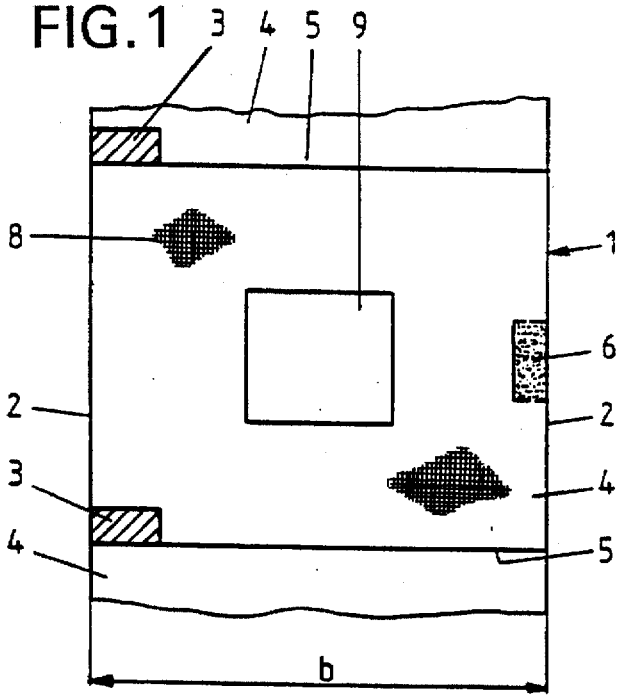

The invention concerns a wrapper, that is, fold-over or envelope-type packaging, wherein piece goods, optionally sub-divisible, are wrapped in an external covering composed of a flat and flexible wrapper material, mutually overlapping edge zones of the wrapper material being bonded together by sealing or gluing.

STATE OF THE ART

A known fold-over wrapper of this kind is used in wrapping chocolate candy and comprises a two-layer envelope composed of two superposed blank-segments, the blank-segment to be located on the outside of the envelope consisting of a decoratively printed foil of two-dimensionally stretched polypropylene (OPP) and the blank-segment to be located on the side of the package facing the article consisting of a compound which on the decoration-side comprises an aluminum foil enameled with a background color and which on the side facing the packaged article is bonded to a layer of paper. The printed OPP foil and the compound foil each are pulled off as strips from rollers at the packaging machine, then both blank-segments are severed to size, whereupon the chocolate-candy envelope is made by said two blank-segments being superposed with a projecting edge of the OPP foil blank-segment, and finally a hot sealing tool is briefly pressed against the two mutually overlapping envelope flaps so that the projecting edge of the OPP foil at the uppermost envelope flap is connected to the outermost layer of the OPP foil of the envelope flap below.

This known fold-over packaging for chocolate candy however is complex in design and operation: two strips of packaging material must be fed to the packaging machine, said strips being independently cut to the right blank-segment lengths and necessitating specified superposition in order to provide the envelope material into which the packaged good are folded-over.

In order to remedy the above drawback, the fold-over packaging for chocolate candy described in the European patent application 480,907 proposes a single-layer packaging material requiring special handling which in an advantageous embodiment is composed of an aluminum/paper composite.

In many instances however a plastic foil is desired for the upper layer of the packaging material. As a rule however this requires multi-layer packaging materials and the bonding of the mutually overlapping edge zones of the packaging material, using a sealing procedure in which the packaged goods must withstand the force applied by a sealing tool, is difficult, if not impossible.

DESCRIPTION OF THE INVENTION

The invention solves the problem of creating a fold-over, i.e. envelope-type packaging or wrapper in which even multi-layer packaging materials can be bonded together by gluing or sealing at mutually overlapping edge zones.

This problem is solved in the wrapper of the invention by a wrapper material which is composed of two different layers of material with the layer facing the piece goods comprising in the uppermost edge zone of the wrapper material one or more cut-outs within which the two edge zones of the wrapper material are interconnected. The layer not provided with cut-outs advantageously is hot-sealing, per se, or is fitted at the lower side, at least at the sites of the cut-outs, with a heat-sealable layer preferably also simultaneously bonding the two different layers of material.

In an advantageous embodiment of the invention, the heat-sealable layer is composed of a hot-sealing wax.

In another advantageous embodiment of the fold-over wrapper of the invention, the layer of material not provided with cut-outs is fitted at its lower side with a permanent-adhesive coating which simultaneously may advantageously bond the two different layers material together.

In another advantageous embodiment of the fold-over wrapper of the invention, that layer of material not provided with cut-outs substantially consists of a plastic foil which, optionally, is transparent.

In a further embodiment of the invention, the layer of material fitted with cut-outs is a composite comprising a decorative aluminum foil, on which, optionally, inscriptions are applied and which on the side facing the packaged article is adhesively bonded to a paper layer.

In another advantageous embodiment of the invention, the two mutually overlapping and joined edge zones of the wrapper material are located at two mutually overlapping envelop folds at the bottom of the wrapper.

In a last advantageous embodiment of the invention, the packaged article is chocolate candy.

SHORT DESCRIPTION OF THE DRAWINGS RELATING TO AN ADVANTAGEOUS EMBODIMENT OF THE INVENTION

The invention is comprehensively discussed below in relation to illustrative embodiments.

To prepare a composite of the packaging material, a strip of aluminum foil between 0.005 and 0.015 mm thick, in particular 0.007 mm thick, is fitted on one side with a background-color pre-enameling using an aqueous acrylate enamel, and on the other side with a wet-laminate bonding agent illustratively made of styrene-butadiene deposited at the rate of about 1.5 g/m$^2$ and bonded to a paper strip with a specific weight between 18 and 100 g/m$^2$. In a further procedural step, this composite is printed and, as described further below, also is provided with cut-outs. To finish the colored wrapper material, a strip of transparent, two-dimensionally stretched polypropylene (OPP) foil between 0.012 and 0.030 mm thick and coated with a wax-based hot-backing adhesive at a rate of 5 to 15 g/m$^2$ is bonded to the composite strip at its printed side by a heat laminating machine. The width of the wrapper strip so made is a multiple of the subsequent length "b" of the wrapper blank which shall be folded over the chocolate candy. Subsequently and following sub-division, the wrapper material is rolled up into individual strips and supplied in this form to the packager.

Figure 4:
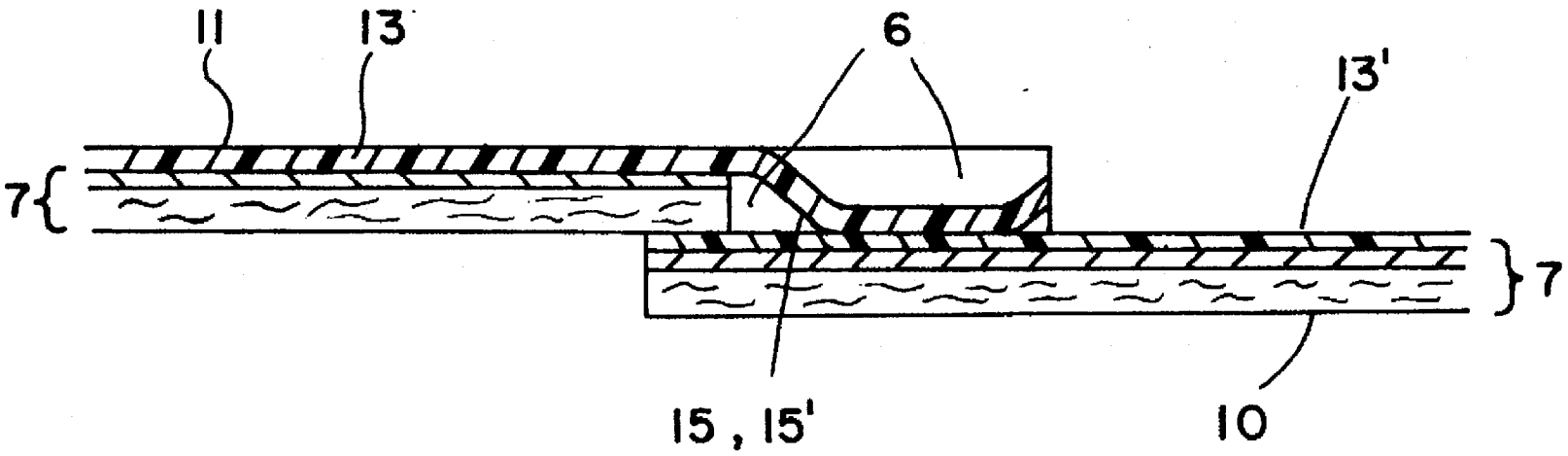

FIG. 1 is a cutaway top-view of the decorative front side of a blank from such an individual strip 1 of width "b" equal to the length of the blank and further shows the laterally cut edge 2 and also the printed scanning marks 3 controlling the packaging machine to sever the strip 1 into blank-segments 4 by sub-division along the lines 5. The already mentioned cut-outs in the aluminum-paper composite 7 are denoted by 6 (FIG. 4). The composite 7 comprises a lustrous embossed surface with the structure of a grid of crossed fine lines, illustratively a rectangular symbol area 9, which where called for evinces a background color other than the remnant surface, the pertinent script being printed in said symbol area which lacks this said lustrous surface.

During packaging, the blank-segments 4 are cut to length from the strip of wrapper material in the packaging machine and the chocolate candies are wrapped in the blank-segments.

Figure 2:
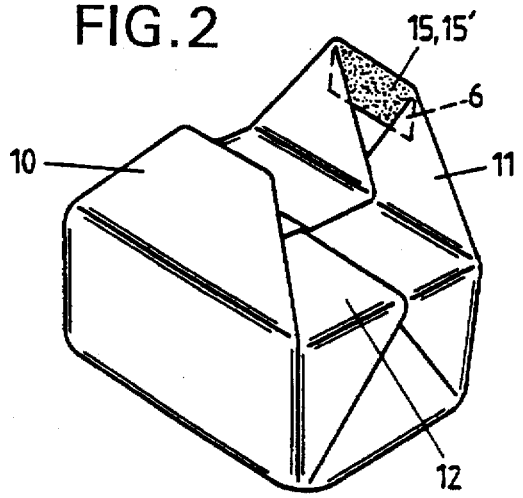
Figure 3:
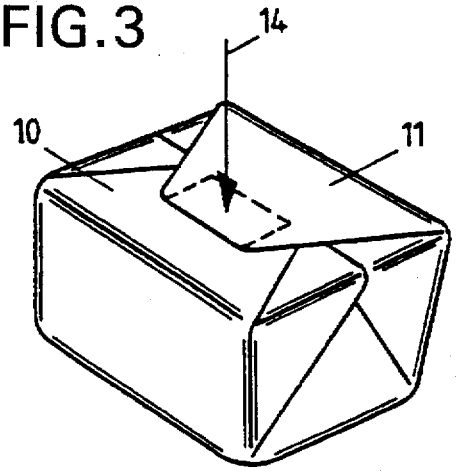

FIG. 2 is a perspective of a phase of folding before the envelope folds 10 and 11 are folded onto the chocolate candy base 12. This Figure also shows the rectangular cut-outs 6 in the aluminum/paper composite 7, leaving the hot-laminate coating 15 deposited on the inside surface of OPP foil 13 within the cut-out (FIG. 4). Thereupon the envelope fold 10 and thereby also the envelope fold 11 are folded onto the chocolate candy base, resulting in the phase shown by FIG. 3 already evincing the final shape of the wrapper. By briefly applying a heated sealing tool in the direction of the arrow 14 on the folded envelope fold 11 within the cut-out 6, the OPP foil 13 of the upper envelope fold 11 is bonded by means of the hot-melt adhesive layer 15 on its inside surface (FIG. 4) to the outside surface of OPP foil 13' of the wrapper material of the lower envelope fold 10. FIG. 4 is a schematic cross-section of the mutually overlapping edge zones of the packaging material at the bonding site.

In another variation of the wrapper of the invention, instead of a hot-melt adhesive layer 15, a permanent adhesive layer 15', namely a pressure-sensitive adhesive layer, is deposited across the full area of the inside surface of OPP foil 13 to bond the composite 7 to OPP foil 13, and this pressure-sensitive adhesive layer 15' appears in the cut-out 6. The use of permanent-adhesive layers at the surface of wrapper materials supplied in particular in roll-wound strips to the packaging plant is unconventional because adjacent layers of the wrapper material may bond to each other at the sites of the permanent adhesive layers, that is, colloquially, the roll material will "lock". Surprisingly this is not the case in this invention: possibly the invention is free from this drawback because of the presence of gaps between the permanent-adhesive layer 15' within the cut-out 6 and the layer of wrapper material underneath, said gaps being of a thickness equal to that of the composite 7. When bonding the two envelope folds 10, 11 during packaging, said gaps however are bridged, by pressing a sealing tool with a small pressure surface, at the cut-out 6, and bonding to the surface of the lower envelope fold is achieved.

We claim:

1. A package containing an item comprising a wrapper folded around the item, said wrapper being comprised of a flexible wrapping material comprised of two different layers of material, said wrapping material having two edge zones disposed on opposite sides thereof, wherein the layer of material which faces the item contains at least one cut-out within one of the two edge zones and the other layer of material is comprised of a plastic foil and is sealable at the location of the cut-out, said wrapper being folded around the item such that the two edge zones of the wrapping material are overlapped and sealed at the cut out.

2. The package as defined by claim 1, wherein said item is a chocolate.

3. A wrapper for wrapping piece goods comprising a flexible wrapping material comprised of two different layers of material, said wrapping material having two edge zones disposed on opposite sides thereof, wherein the layer of material adapted to face the wrapped goods contains at least one cut-out within one of the two edge zones and the other layer of material is comprised of a plastic foil and is sealable at least at the location of the cut-out such that the wrapper can be sealed to itself at the cut-out for wrapping piece goods.

4. The wrapper defined by claim 3, wherein the layer of material which does not contain the cut-out is heat-sealable and bonds the two different layers of material together.

5. The wrapper defined by claim 3, wherein the layer of material which does not contain the cut-out comprises a material which is heat-sealable at least in the area exposed by the cut-out.

6. The wrapper defined by claim 5, wherein the heat-sealable material is comprised of a heat-sealing wax.

7. The wrapper defined by claim 3, wherein the layer of material which does not contain the cut-out contains a permanent adhesive coating at least in the area exposed by the cut-out.

8. The wrapper defined by claim 7, wherein said layer of material which does not contain the cut-out contains a permanent adhesive coating which bonds the two different layers of material together.

9. The wrapper defined by claim 3, wherein the layer of material which does not contain the cut-out is comprised of a plastic foil.

10. The wrapper defined by claim 9, wherein the plastic foil is transparent.

11. The wrapper as defined by claim 10, wherein the layer of material which contains the cut-out is a composite layer of material comprising a decorative aluminum foil having a paper layer joined thereto by an adhesive coating on the side adapted to face the wrapped goods.

* * * * *

UNITED STATES PATENT AND TRADEMARK OFFICE

CERTIFICATE OF CORRECTION

PATENT NO. : 5,671,882

DATED : Sep. 30, 1997

INVENTOR(S) : Herbert CERWINSKI et al.

It is certified that error appears in the above-indentified patent and that said Letters Patent is hereby corrected as shown below:

On the title page:

After line [30], under the heading "Foreign Application Priority Data", change "[AU] Australia" to --[AT] Austria--.

Signed and Sealed this

Thirteenth Day of January, 1998

Bruce Lehman

*Attest:*

BRUCE LEHMAN

*Attesting Officer*

*Commissioner of Patents and Trademarks*